US009734791B2

(12) United States Patent
Obinata et al.

(10) Patent No.: US 9,734,791 B2
(45) Date of Patent: Aug. 15, 2017

(54) DISPLAY CONTROL DEVICE AND METHOD, SEMICONDUCTOR INTEGRATED CIRCUIT DEVICE, AND DISPLAY DEVICE

(71) Applicant: SEIKO EPSON CORPORATION, Tokyo (JP)

(72) Inventors: Atsushi Obinata, Hachioji (JP); Chisato Higuchi, Fuchu (JP); Katsumi Okina, Fuchu (JP)

(73) Assignee: SEIKO EPSON CORPORATION, Tokyo (JP)

( * ) Notice: Subject to any disclaimer, the term of this patent is extended or adjusted under 35 U.S.C. 154(b) by 149 days.

(21) Appl. No.: 14/516,067

(22) Filed: Oct. 16, 2014

(65) Prior Publication Data

US 2015/0103083 A1 Apr. 16, 2015

(30) Foreign Application Priority Data

Oct. 16, 2013 (JP) ..... 2013-215265

(51) Int. Cl.
*G09G 3/20* (2006.01)
*G09G 5/00* (2006.01)

(52) U.S. Cl.
CPC ..... *G09G 5/005* (2013.01); *G09G 3/2096* (2013.01); *G09G 5/008* (2013.01)

(58) Field of Classification Search
CPC ..... G06T 3/40; G06T 3/4053; G06T 3/4084; G09G 3/2096

(Continued)

(56) References Cited

U.S. PATENT DOCUMENTS 5,276,458 A * 1/1994 Sawdon ..... G09G 1/16 345/698
5,587,721 A * 12/1996 Koiwa ..... G09G 3/2011 345/691

(Continued)

FOREIGN PATENT DOCUMENTS

JP H02-187790 A 7/1990
JP A-5-19728 1/1993

(Continued)

OTHER PUBLICATIONS

"What is a PLL?", Future Electronics, accessible at http://www.futureelectronics.com/en/wireless-rf-radio-frequency/pll-phase-locked-loop.aspx, archived by the internet archive (https://archive.org/web/) on Jun. 22, 2012.*

*Primary Examiner* — Jacinta M Crawford
*Assistant Examiner* — Phong Nguyen
(74) *Attorney, Agent, or Firm* — Oliff PLC

(57) ABSTRACT

A display control device includes a first interface unit that receives display information of a first display method that includes image data and a control information setting unit that sets control information used for controlling display of an image in the display unit in accordance with setting information that specifies a display method. The display control device further includes an image data conversion unit that converts, if a second display method is specified by the setting information, the image data of the first display method type to image data of the second display method type in accordance with the control information. The display control device also includes a second interface unit that outputs the image data of the first or the second display method type in accordance with the setting information, and outputs signals for controlling the display unit in accordance with the control information.

18 Claims, 4 Drawing Sheets

(58) Field of Classification Search
USPC ..... 345/660, 668
See application file for complete search history.

(56) References Cited

U.S. PATENT DOCUMENTS 6,181,313 B1 * 1/2001 Yokota ..... G09G 3/36 345/100
6,181,330 B1 * 1/2001 Yui ..... G09G 5/003 345/204
6,809,716 B1 * 10/2004 Kim ..... G09G 5/005 345/3.2
7,089,342 B2 * 8/2006 Arai ..... G06F 3/153 345/3.1
9,019,353 B2 * 4/2015 Jeong ..... H04N 13/0454 348/51
2002/0036635 A1 * 3/2002 Shimamoto ..... G06F 1/266 345/211
2002/0180718 A1 * 12/2002 La ..... G09G 5/006 345/204
2003/0067552 A1 * 4/2003 Leyvi ..... G09G 5/005 348/453
2003/0145184 A1 7/2003 Sato et al.
2006/0077213 A1 * 4/2006 Li ..... G06T 3/4007 345/660
2006/0109226 A1 * 5/2006 Tyrrell ..... G09G 3/3611 345/98
2007/0075956 A1 * 4/2007 Satou ..... G09G 3/3614 345/98
2007/0165014 A1 * 7/2007 Shin ..... G09G 3/3622 345/204
2008/0192037 A1 * 8/2008 Lee ..... G06F 3/1431 345/205
2009/0091585 A1 * 4/2009 Koyanagi ..... G06T 3/4007 345/660
2009/0153473 A1 * 6/2009 Davis ..... G06F 1/1616 345/157
2011/0085404 A1 4/2011 Yoko
2011/0285757 A1 * 11/2011 Cummings ..... G09G 3/2003 345/690
2012/0050334 A1 * 3/2012 Velthoven ..... G06T 3/4092 345/660
2013/0076703 A1 * 3/2013 Baek ..... G09G 3/2092 345/204
2013/0169654 A1 7/2013 Kim et al.

FOREIGN PATENT DOCUMENTS

JP H05-307168 A 11/1993
JP H06-083566 A 3/1994
JP A-9-34411 2/1997
JP A-9-128182 5/1997
JP H11-311969 A 11/1999
JP 2002-323883 A 11/2002
JP A-2003-228978 8/2003
JP A-2007-207003 8/2007
JP A-2011-81888 4/2011
JP A-2013-141230 7/2013

* cited by examiner

DISPLAY CONTROL DEVICE AND METHOD, SEMICONDUCTOR INTEGRATED CIRCUIT DEVICE, AND DISPLAY DEVICE

CROSS-REFERENCE TO RELATED APPLICATIONS

This application claim benefit of Japanese Application JP 2013-215265, filed on Oct. 16, 2013. The disclosure of the prior application is hereby incorporated by reference herein in its entirety.

BACKGROUND

1. Technical Field

Various embodiments relate to a display control device and a display control method for controlling a display unit that includes a display panel such as an LCD (Liquid Crystal Display) panel for displaying images in electronic apparatuses such as an in-car display system and a mobile phone. Moreover, the various embodiments relate to a semiconductor integrated circuit device, a display device, and the like that include such a display control device.

2. Related Art

For example, an STN (Super-Twisted Nematic) display panel is used as an LCD panel. STN is a mode of a liquid crystal that uses Nematic liquid crystal in which the twist angle of the liquid crystal molecule is made large to about 180 to 270°. However, it is generally understood as a display method in a passive matrix type display panel that uses such liquid crystal.

In contrast, usage of an active matrix type display panel that uses TFTs (Thin Film Transistors) is increasing recently. However, when a switch to a TFT display panel having an arbitrary size is carried out in an electronic apparatus that uses an STN display panel, a large-scale change including a modification of software is required due to the change in the interface with the display panel. In view of this, it is desired that a switch to a TFT display panel can be realized without modification of the software.

As a related art, JP-A-9-34411 (paragraphs [0005] and [0007], claim 4) discloses an LCD controller that is capable of, by processing display data, displaying an image on an entire screen continuously without redrawing, when the resolution of the display is different from the number of pixels in the image data. The LCD controller is a display controller for displaying image data, which is stored in a display memory, on a liquid crystal display, includes a resolution ratio setting unit for setting a ratio between the number of pixels in the image data in the display memory and the resolution of the display, and a shift register for transferring the image data in the display memory to the display as serial data, and adjusts a shift clock of the shift register based on the output of the resolution ratio setting unit such that the serial data is suited to the resolution of the display, when the image data is transferred to the display.

According to JP-A-9-34411, since redrawing of a display memory to perform enlargement/reduction of an image is not required when the display data is transferred to a display, the image can be displayed according to the size of the screen without a modification of the software. However, in order to precisely deal with a plurality of types of display panels having different sizes, it is not sufficient just to adjust the ratio between the number of pixels in the image data and the resolution of the display, or to adjust the shift clock of the shift register, and various signals for controlling the display unit including the display panel need to be changed according to the size of the display panel.

Also, in JP-A-9-128182 (paragraphs [0001] and [0007], claim 1), a display device is disclosed that is connected to a display adapter circuit of a computer system, in a display system in which control data (data including a video signal and a timing parameter to generate a synchronization signal) is transferred between the computer system and the display device. The display device is a display device that includes a unit to generate a visual output in response to a plurality of data signals generated by the display adapter circuit, and includes a memory that stores control data in the form of a plurality of control codes for identifying the display device, and a device logic unit that responds to a command signal from the display adapter circuit for reading the control code from the memory and transmitting the control code to the display adapter circuit.

According to JP-A-9-128182, there is an advantage in that the programming of the display system does not need to be updated every time another display device is connected to an output port. Instead, the display device needs to transmit control data to the display adapter circuit in the form of a plurality of control codes for identifying the display device.

SUMMARY

An advantage of one or more embodiments disclosed herein is to provide a display control device and a display control method that can deal with a switch of a display panel without modifying software and receiving control data from a display unit, even in a case where the display method of a display panel used in an electronic apparatus is changed. Furthermore, another advantage of one or more embodiments is to provide a semiconductor integrated circuit device, display device, and the like that include such a display control device.

A display control device according to a first embodiment is a display control device for controlling a display unit including a display panel, and includes a first interface unit that receives display information of a first display method type that includes image data; a control information setting unit that sets control information used for controlling display of an image in the display unit in accordance with setting information that specifies a display method; an image data conversion unit that, if a second display method that is different from the first display method is specified by the setting information, converts the image data of the first display method type to image data of the second display method type in accordance with the control information; and a second interface unit that outputs the image data of the first display method type if the first display method is specified by the setting information, outputs the image data of the second display method type if the second display method is specified by the setting information, and outputs a signal for controlling the display unit in accordance with the control information.

Also, a display control method according to one embodiment is a display control method for controlling a display unit including a display panel, and includes (a) receiving display information of a first display method type that includes image data; (b) setting control information used for controlling display of an image in the display unit in accordance with setting information that specifies a display method; (c) converting, if a second display method that is different from the first display method is specified by the setting information, the image data of the first display method type to image data of the second display method type in accordance with the control information set in step (b); and (d) outputting the image data of the first display method type if the first display method is specified by the setting information, outputting the image data of the second display method type if the second display method is specified by the setting information, and outputting a signal for controlling the display unit in accordance with the control information set in step (b).

According to the first embodiment, due to setting control information in accordance with setting information that specifies a selected display method out of a plurality of display methods, and converting image data and outputting signals for controlling the display unit in accordance with the control information, a switch of the display panel can be dealt with without modifying software and receiving control data from the display unit, even in a case where the display method of the display panel used in an electronic apparatus is changed.

Here, the display control device may further include a display clock signal generation unit that generates a display clock signal having a frequency that corresponds to the control information, and the second interface unit may output the display clock signal generated by the display clock signal generation unit to the display unit. Accordingly, the display unit can be controlled by a display clock signal corresponding to the display method of the display panel. The display clock signal generation unit may include a PLL (phase locked loop) circuit that generates a clock signal based on a system clock signal that is supplied from outside.

Also, the display clock signal generation unit may include a PLL (phase locked loop) circuit that generates a clock signal having a frequency that corresponds to the control information, based on a system clock signal that is supplied from outside. Accordingly, display clock signals that conform to a plurality of display methods can be generated without providing a plurality of oscillators.

In the above, the image data conversion unit may convert, if the second display method that is different from the first display method is specified by the setting information, an image size of the image data of the first display method type to an image size specified by the control information. Accordingly, image data having an image size that conforms to the second display method can be generated.

Also, the control information setting unit may include at least one terminal for specifying a display method, and may set the control information in accordance with a signal that shows a connection condition of the at least one terminal. Accordingly, setting information that specifies the selected display method can be set by merely setting the connection condition of at least one terminal.

Furthermore, the control information setting unit may include a storage unit for storing control information that corresponds to a plurality of display methods, and may read out the control information corresponding to the setting information that specifies the display method from the storage unit. Accordingly, control information can be set without receiving control information from outside.

For example, the first display method may be a display method for causing a display unit having an STN (Super-Twisted Nematic) display panel to display an image, and the second display method may be a display method for causing a display unit having a TFT (Thin Film Transistor) display panel to display an image. In this case, a switch of the display panel can be dealt with without modifying software and receiving control data from the display unit, even in a case where the display panel used in an electronic apparatus has been switched from an STN display panel to a TFT display panel.

A display control device according to a second embodiment further includes a third interface unit that outputs the image data of the first display method type, and outputs a signal for controlling a display unit that uses the first display method in accordance with at least one parameter included in the display information of the first display method type. According to the second embodiment, it is possible to control both a display unit that uses the first display method and a display unit that uses the second display method.

In the above, the control information may include information for specifying at least one of an enlargement ratio or a reduction ratio of an image size, a horizontal pixel number, a vertical line number, a horizontal cycle, a vertical cycle, a horizontal back porch, a vertical back porch, a horizontal synchronization signal width, a vertical synchronization signal width, the polarity of a display clock signal, the driving capability of an output circuit of the first interface unit, and the frequency of a display clock signal. It is possible to convert image data and generate signals for controlling the display unit in accordance with such control information.

A semiconductor integrated circuit device according to an aspect of one or more embodiments includes any of the above display control devices. Accordingly, a display control device can be downsized and be placed in the vicinity of a display panel. Also, a display device according to an aspect of one or more embodiments includes any of the above display control devices, and a display unit including a display panel. Accordingly, a display device that has integrated functions relating to image display can be provided.

BRIEF DESCRIPTION OF THE DRAWINGS

The various embodiments will be described with reference to the accompanying drawings, wherein like numbers reference like elements.

DETAILED DESCRIPTION

Figure 1:
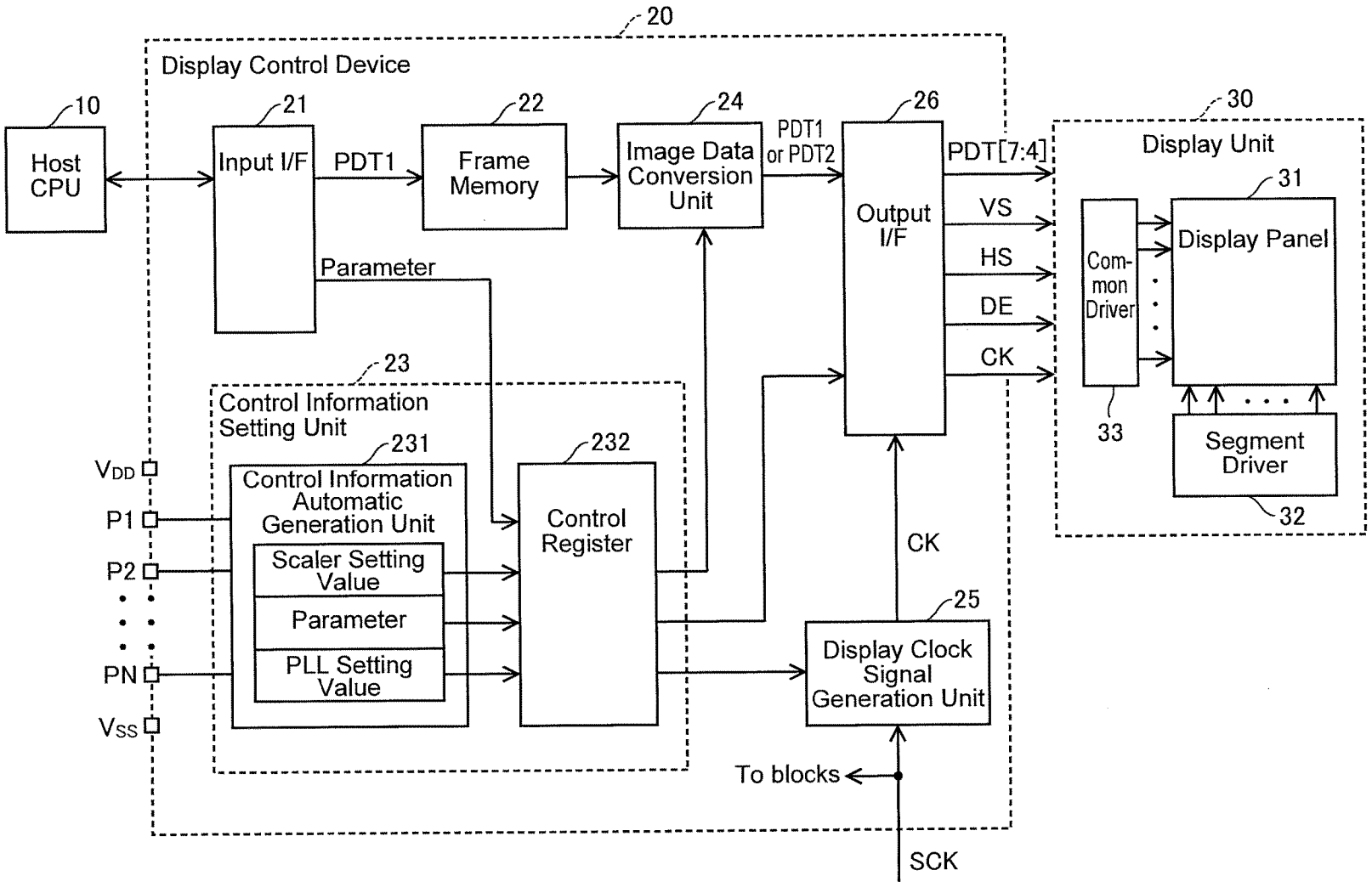
FIG. 1 is a block diagram of an electronic apparatus including a display control device according to a first embodiment.

Hereinafter, various embodiments will be described in detail with reference to the drawings. Note that the same reference signs are given to the same constituent elements, and redundant descriptions will be omitted. FIG. 1 is a block diagram showing an exemplary configuration of an electronic apparatus including a display control device according to a first embodiment. This electronic apparatus is an electronic apparatus such as an in-car display system or a mobile phone, and only portions relating to image display are shown in FIG. 1.

As shown in FIG. 1, this electronic apparatus includes a host CPU (Central Processing Unit) 10 that controls the units of the electronic apparatus, a display control device 20 that performs image processing and control relating to image display, and a display unit 30 that displays an image on a display panel 31 based on image data, a synchronization signal, and the like that are output from the display control device 20.

Here, the display control device 20 and the display unit 30 constitute a display device. A display device in which functions relating to image display are integrated can thereby be provided. Also, the display control device 20 may be incorporated in a semiconductor integrated circuit device (display controller IC). The display control device 20 can thereby be downsized and be placed in the vicinity of the display panel 31.

In the display unit 30, a passive matrix type STN display panel that uses an STN liquid crystal or an active matrix type TFT display panel that uses TFTs can be used. Note that since the distance between pixels is fixed in an LCD panel and an organic EL (Electro-Luminescence) panel, in a case where an image of 640×480 pixels is displayed on the display panel that is capable of displaying an image of 800×600 pixels, an unoccupied region is generated in the display panel.

Accordingly, when a switch is carried out to a display panel having an arbitrary size (number of pixels) in an electronic apparatus that uses an LCD panel or an organic EL panel, image data, a synchronization signal, a display clock signal, and the like that are output to the display unit 30 need to be changed such that an image is displayed by a display method that is appropriate for the size of the display panel. Here, the "display method" refers to a method relating to the number of pixels (image size) included in one frame worth of image data, timings such as the vertical cycle and the horizontal cycle, the frequency of the display clock signal, and the like.

In the present embodiment, the display control device 20 is configured to be capable of controlling the display unit 30 so as to correspond to the selected display method out of a plurality display methods, without modifying software that is executed in the host CPU 10 or receiving control data from the display unit 30.

Hereinafter, as an example, it is assumed that the plurality of display methods include a first display method for displaying an image in a display unit that includes an STN display panel having a predetermined size, and a second display method for displaying an image in a display unit that includes a TFT display panel having a size that is different from the size of the STN display panel. In such a case, a switch of the display panel can be dealt with without modifying software or receiving control data from the display unit 30, even in a case where the display panel used in an electronic apparatus is switched from an STN display panel to a TFT display panel. It should be appreciated that different display methods are contemplated and within the scope of this disclosure.

The display control device 20 includes an input I/F (interface unit) 21, a frame memory 22, a control information setting unit 23, an image data conversion unit 24, a display clock signal generation unit 25, and an output I/F (interface unit) 26.

The input interface unit 21 receives display information of the first display method type including image data PDT1 and a plurality of parameters from the host CPU 10. For example, the image data PDT1 has an image size corresponding to the number of pixels in the STN display panel. Also, the plurality of parameters include a predetermined number of parameters for controlling the display of an image in a display unit that includes an STN display panel and a parameter showing the image size of the image data PDT1.

The input interface unit 21 outputs the plurality of parameters of the first display method type to the control information setting unit 23, along with outputting the image data PDT1 of the first display method type to the frame memory 22. The frame memory 22 stores the image data PDT1 of the first display method type that is output from the input interface unit 21.

The control information setting unit 23 sets control information used for controlling the display of an image in the display unit 30 in accordance with setting information that specifies the selected display method out of the plurality of display methods. The control information includes information that specifies at least one of a scaler setting value (enlargement ratio or reduction ratio of the image size), various parameters that are used in the output interface unit 26, and a PLL setting value (frequency of the display clock signal).

The various parameters that are used in the output interface unit 26 are a horizontal pixel number, a vertical line number, a horizontal cycle, a vertical cycle, a horizontal back porch, a vertical back porch, a horizontal synchronization signal width, a vertical synchronization signal width, the polarity of a display clock signal, the driving capability of an output circuit in the output interface unit 26, and the like. It becomes possible to convert the image data and to generate signals for controlling the display unit 30 in accordance with such control information. It should be appreciated that other parameters are contemplated by this disclosure.

Here, the control information setting unit 23 includes at least one terminal (a plurality of terminals P1 to PN are shown in FIG. 1) for specifying the selected display method out of the plurality of display methods, and may set control information following a signal that shows the connection condition of the at least one terminal. Accordingly, by merely setting the connection condition of the at least one terminal, the setting information for specifying the selected display method out of the plurality of display methods can be set.

For example, by connecting two size setting terminals for setting an enlargement ratio or a reduction ratio of the image size to wiring at a power supply potential $V_{DD}$ on the high-potential side or wiring at a power supply potential $V_{SS}$ on the low-potential side, one scaler setting value can be specified out of four scaler setting values. Similarly, a clock polarity selection terminal for selecting the polarity of the display clock signal, a drive capability setting terminal for setting the driving capability of the output circuit in the output interface unit 26, a clock frequency setting terminal for setting the frequency of the display clock signal, and the like may be provided.

Alternatively, the control information setting unit 23 may include a nonvolatile memory or the like for storing setting information in place of the terminals P1 to PN, and may set the control information in accordance with the setting information stored in the nonvolatile memory or the like. Also, if the setting information is included in the plurality of parameters that the input interface unit 21 receives from the host CPU 10, the control information setting unit 23 may set the control information in accordance with the setting information that the input interface unit 21 receives from the host CPU 10. In either case, a user can set the setting information for specifying the selected display method out of the plurality of display methods in the control information setting unit 23.

The control information setting unit 23 includes a control information automatic generation unit 231 and a control register 232. The control information automatic generation unit 231 includes a storage unit constituted by a nonvolatile memory or the like for storing pieces of the control information that are used for controlling the display of an image conforming to the respective display methods, in correspondence with the pieces of information that specify the plurality of display methods. If the setting information that specifies the selected display method out of the plurality of display methods is set, the control information automatic generation unit 231 reads out the control information corresponding to the setting information from the storage unit. The control information setting unit 23 can thereby set the control information without receiving the control information from outside.

The control register 232 holds a plurality of parameters of the first display method type that the input interface unit 21 received from the host CPU 10, and also holds the control information that the control information automatic generation unit 231 read out from the storage unit or the control information calculated based on the read-out control information. Note that a memory such as a nonvolatile memory, or other type of memory, may be used in place of the control register 232.

Here, in a case where the second display method that is different from the first display method is specified by the setting information, the predetermined number of parameters of the first display method type that the input interface unit 21 received from the host CPU 10 are replaced by various parameters of the second display method type that are generated by the control information automatic generation unit 231. Note that the parameter that specifies the image size of the image data PDT1 of the first display method type is held as-is. This parameter may be used to convert the image data or to calculate the scaler setting value or the PLL setting value.

If the second display method that is different from the first display method is specified by the setting information, the image data conversion unit 24 converts the image data PDT1 of the first display method type that is read out from the frame memory 22 to the image data PDT2 of the second display method type, in accordance with the control information set by the control information setting unit 23.

Here, if the second display method that is different from the first display method is specified by the setting information, the image data conversion unit 24 may include a scaler that converts the image size of the image data PDT1 of the first display method type that was read out from the frame memory 22 to the image size that is specified by the control information (scaler setting value) that was set by the control information setting unit 23. The image data PDT2 having an image size that conforms to the second display method is thereby generated.

For example, in a case where the display panel of the display unit 30 has 800×600 pixels, and one frame in the image data PDT1 of the first display method type is configured by 640×480 pixels, the scaler enlarges the image size by performing interpolation processing or the like on the image data PDT1 of the first display method type such that the number of pixels in the horizontal direction and the number of pixels in the vertical direction are respectively enlarged by 1.25.

On the other hand, if the first display method is specified by the setting information, the image data conversion unit 24 may output the image data PDT1 of the first display method type as-is. For example, due to setting the scaler setting value to "1", the image size in the image data PDT1 of the first display method type is maintained.

Accordingly, the image data conversion unit 24 outputs the image data PDT1 of the first display method type to the output interface unit 26 if the first display method is specified by the setting information, and outputs the image data PDT2 of the second display method type to the output interface unit 26 if the second display method is specified by the setting information.

Alternatively, if the first display method is specified by the setting information, the image data PDT1 of the first display method type that is read out from the frame memory 22 may be directly supplied to the output interface unit 26 by bypassing the image data conversion unit 24.

The display clock signal generation unit 25 generates a display clock signal CK having a frequency that corresponds to the control information that is set by the control information setting unit 23. The display unit 30 can thereby be controlled by the display clock signal CK appropriate for the size of the display panel. The display clock signal generation unit 25 includes a PLL (phase locked loop) circuit that generates a clock signal based on a system clock signal that is supplied from outside.

For example, the display clock signal generation unit 25 may include a programmable PLL (phase locked loop) circuit that generates, based on the system clock signal SCK supplied from the outside, the display clock signal CK having a frequency that corresponds to the control information (PLL setting value) that was set by the control information setting unit 23. The display clock signal CK that is appropriate for each of the plurality of display methods can thereby be generated without providing a plurality of oscillators.

The programmable PLL circuit includes, for example, a VCO (voltage-controlled oscillator) in which the oscillation frequency is controlled by a control voltage, a frequency division circuit that generates a frequency-division signal by dividing the display clock signal CK output from the VCO with a desired frequency-division ratio, and a comparator that generates a control voltage by comparing the phase or the frequency of the frequency-division signal with the phase or the frequency of the system clock signal SCK. The display clock signal CK having a desired frequency can thereby be obtained by multiplying the frequency of the system clock signal SCK.

The output interface unit 26 outputs image data PDT [7:4] to the display unit 30 based on the image data PDT1 of the first display method type if the first display method is specified by the setting information, and outputs image data PDT [7:4] to the display unit 30 based on the image data PDT2 of the second display method type if the second display method is specified by the setting information.

Furthermore, the output interface unit 26 outputs signals for controlling the display unit 30 in accordance with the control information set by the control information setting unit 23. For example, the output interface unit 26 generates a vertical synchronization signal VS, a horizontal synchronization signal HS, and a data enable signal DE in accordance with the control information (various parameters) set by the control information setting unit 23, and outputs the signals to the display unit 30. Also, the output interface unit 26 outputs the display clock signal CK generated by the display clock signal generation unit 25 to the display unit 30.

Figure 2:
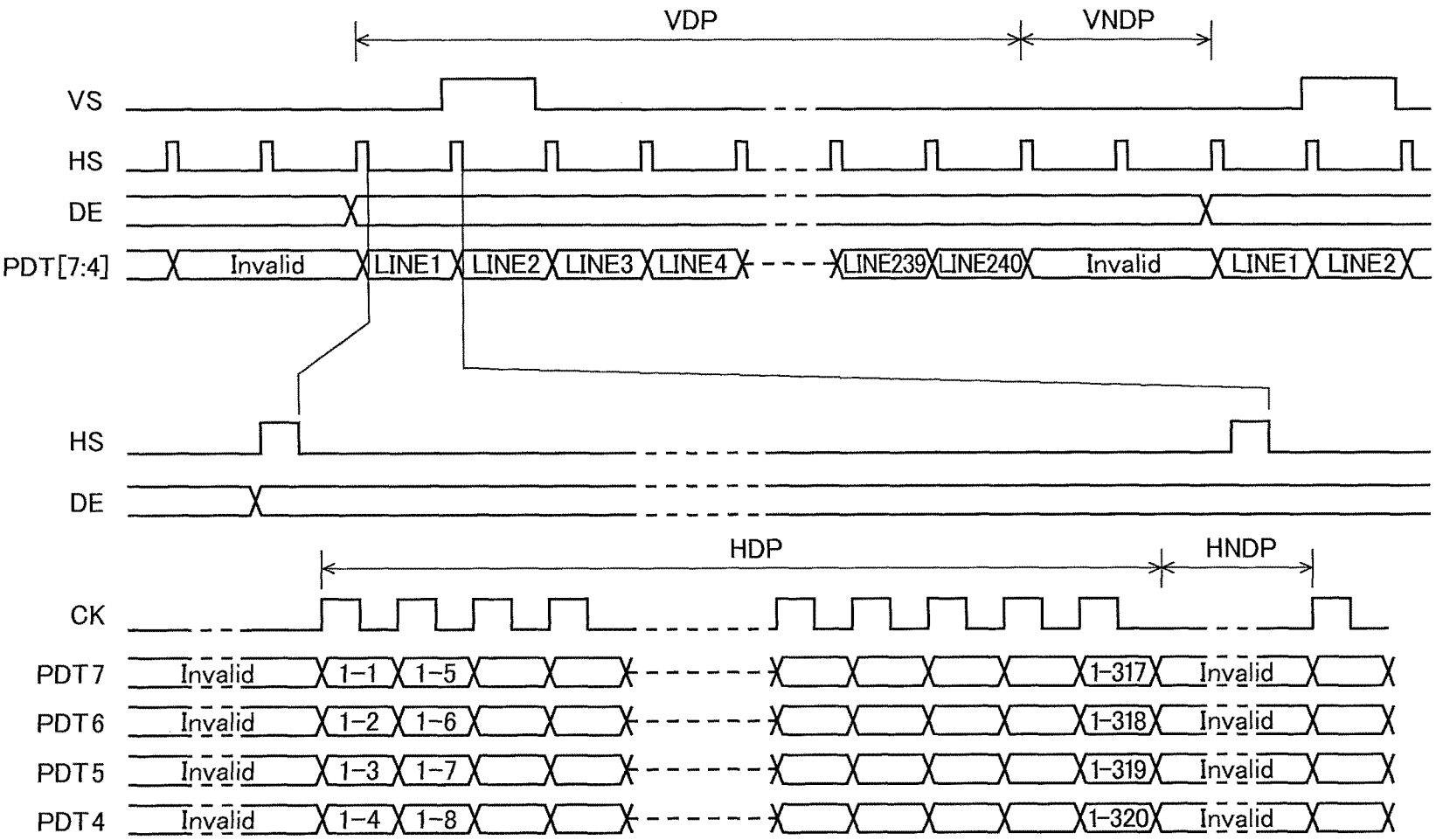
FIG. 2 is a waveform diagram showing waveforms of various signals that are output from an output interface unit.

FIG. 2 is a waveform diagram that shows an example of waveforms of various signals that are output from the output interface unit shown in FIG. 1. In FIG. 2, the vertical synchronization signal VS, the horizontal synchronization signal HS, the data enable signal DE, and the image data PDT [7:4] are shown. The image data PDT [7:4] shows four pixels worth of data PDT7, PDT6, PDT5, and PDT4.

In FIG. 2, VDP shows a period in which pixel information is output in the vertical synchronization period, and VNDP shows a period in which pixel information is not output (vertical back porch) in the vertical synchronization period. Also, HDP shows a period in which pixel information is output in the horizontal synchronization period, and HNDP shows a period in which pixel information is not output (horizontal back porch) in the horizontal synchronization period.

Referring again to FIG. 1, the display unit 30 includes the display panel 31 that displays an image, a segment driver 32, and a common driver 33. Here, the segment driver 32 and the common driver 33 may be incorporated in the semiconductor integrated circuit device (display driver IC).

The segment driver 32 drives a plurality of terminals arranged in the horizontal direction (lateral direction in the diagram) in the display panel 31. The common driver 33 drives a plurality of terminals arranged in the vertical direction (longitudinal direction in the diagram) in the display panel 31. In this way, the display unit 30 displays an image based on the various signals output from the output interface unit 26.

Note that, when the display panel 31 is an STN display panel, the segment driver 32 is also referred to as a signal line driving circuit, and the common driver 33 is also referred to as a scanning line driving circuit. Also, when the display panel 31 is a TFT display panel, the segment driver 32 is also referred to as a source line driving circuit, and the common driver 33 is also referred to as a gate line driving circuit.

Figure 3:
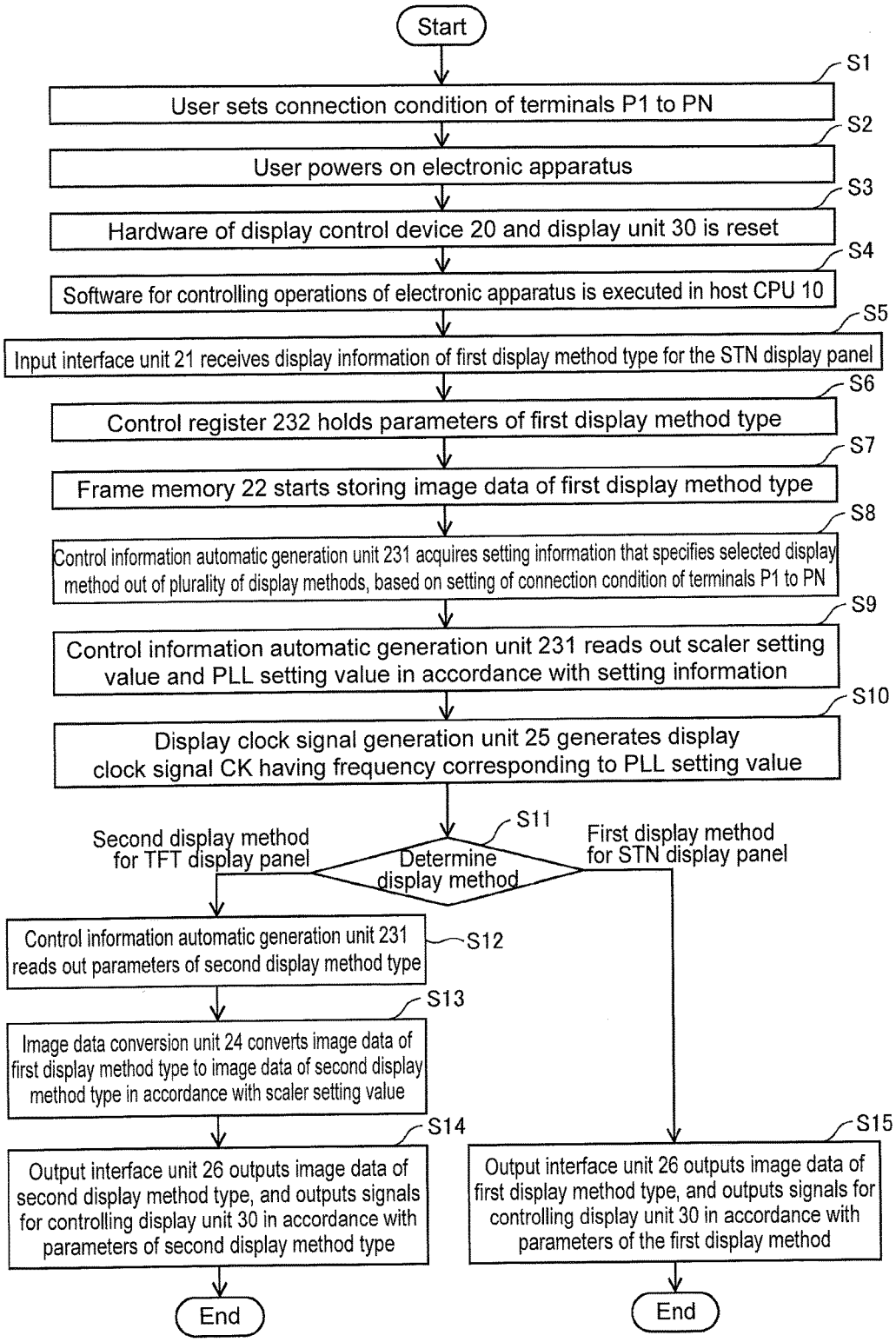
FIG. 3 is a flowchart showing a display control method according to one embodiment.

Next, a display control method executed by using the display control device shown in FIG. 1 will be described with reference to FIG. 1 and FIG. 3. FIG. 3 is a flowchart that shows the display control method according to the first embodiment.

In step S1 in FIG. 3, a user sets a connection condition of the terminals P1 to PN in the control information setting unit 23. The setting information that specifies the selected display method out of the plurality of display methods is thereby set.

In step S2, the user powers on the electronic apparatus. In step S3, a power supply voltage is thereby supplied to the units of the electronic apparatus, and hardware of the display control device 20 and the display unit 30 is reset.

In step S4, software for controlling operations of the electronic apparatus is executed in the host CPU 10. The host CPU 10 transmits the display information of the first display method type including the image data PDT1 for the STN display panel and a plurality of parameters to the display control device 20.

In step S5, the input interface unit 21 of the display control device 20 receives the display information of the first display method type including the image data PDT1 for the STN display panel and the plurality of parameters. The input interface unit 21 outputs the image data PDT1 of the first display method type to the frame memory 22, along with outputting the plurality of parameters of the first display method type to the control information setting unit 23.

In step S6, the control register 232 of the control information setting unit 23 holds the plurality of parameters of the first display method type. Also, in step S7, the frame memory 22 starts storing the image data PDT1 of the first display method type.

In step S8, the control information automatic generation unit 231 of the control information setting unit 23 acquires the setting information that specifies the selected display method out of the plurality of display methods, based on the setting of the connection condition of the terminals P1 to PN.

In step S9, the control information automatic generation unit 231 reads out the scaler setting value and the PLL setting value from the storage unit in accordance with the setting information, and causes the control register 232 to hold the scaler setting value and the PLL setting value. Also, in step S10, the display clock signal generation unit 25 generates the display clock signal CK having a frequency that corresponds to the PLL setting value.

In step S11, the control information automatic generation unit 231 determines the display method specified by the setting information. The processing moves to step S12 if the second display method for the TFT display panel is specified by the setting information, and the processing moves to step S15 if the first display method for the STN display panel is specified by the setting information.

In step S12, the control information automatic generation unit 231 reads out the various parameters of the second display method type for the TFT display panel from the storage unit, and replaces the predetermined number of parameters of the first display method type held in the control register 232 with the various parameters of the second display method type.

In this way, in steps S6, S9, S11, and S12, the control information (scaler setting value, various parameters, and PLL setting value) used for controlling the display of an image in the display unit 30 is set in accordance with the setting information that specifies the selected display method out of the plurality of display methods.

In step S13, the image data conversion unit 24 converts the image data PDT1 of the first display method type to the image data PDT2 of the second display method type in accordance with the scaler setting value. Also, in step S14, the output interface unit 26 outputs the image data of the second display method type for the TFT display panel to the display unit 30, and outputs signals for controlling the display unit 30 to the display unit 30 in accordance with the various parameters of the second display method type for the TFT display panel.

On the other hand, in step S15, the output interface unit 26 outputs the image data of the first display method type for the STN display panel to the display unit 30, and outputs signals for controlling the display unit 30 to the display unit 30 in accordance with the plurality of parameters of the first display method type for the STN display panel.

According to the first embodiment, due to setting the control information in accordance with the setting information that specifies the selected display method out of the plurality of display methods, and converting the image data and outputting signals for controlling the display unit 30 in accordance with the control information, a switch of the display panel 31 can be dealt with without modifying the software and receiving the control data from the display unit 30, even in a case where the size of the display panel 31 used in an electronic apparatus is changed.

Next, a second embodiment will be described.

Figure 4:
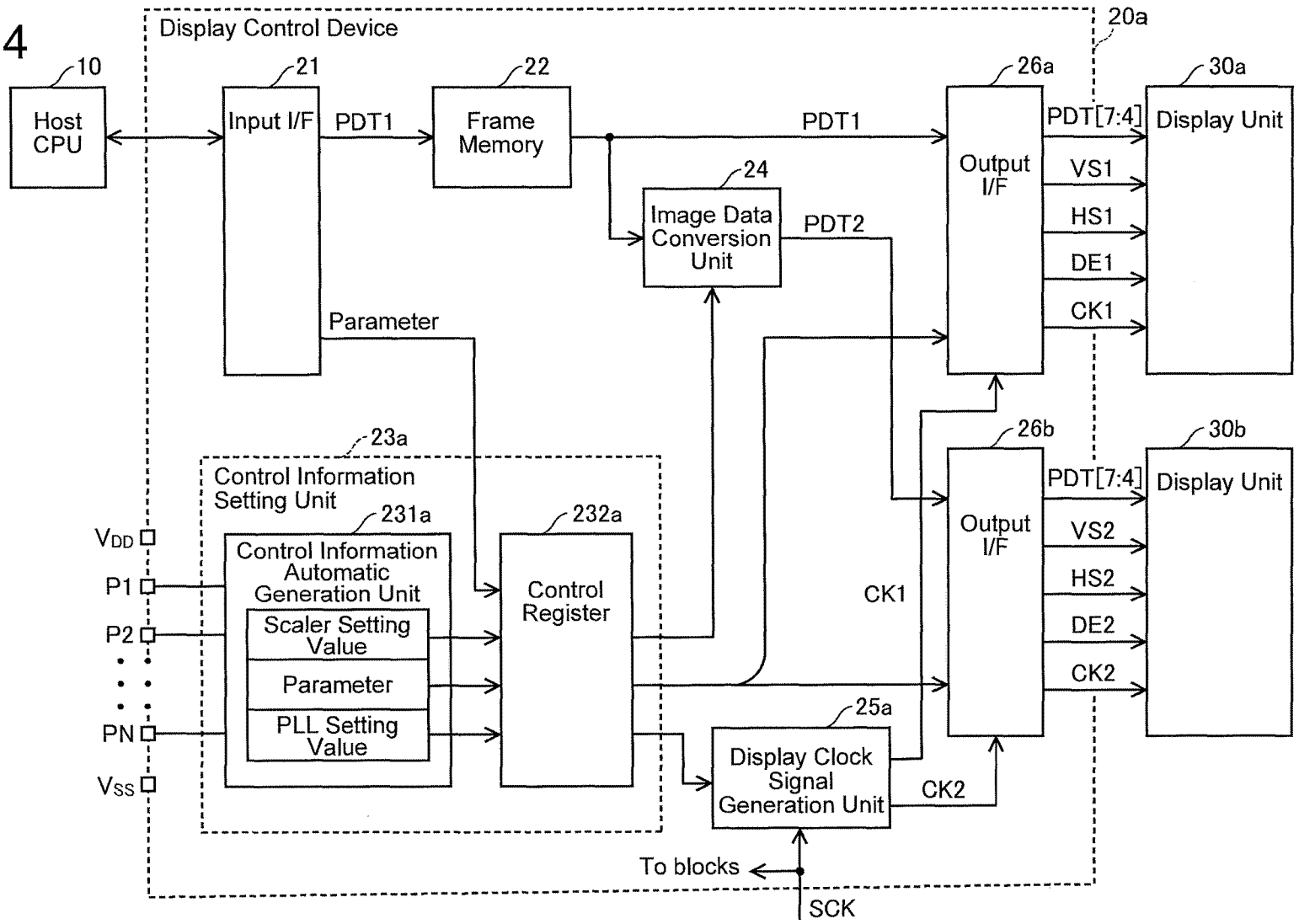
FIG. 4 is a block diagram of an electronic apparatus that includes a display control device according to a second embodiment.

FIG. 4 is a block diagram showing an exemplary configuration of an electronic apparatus including a display control device according to the second embodiment. In the second embodiment shown in FIG. 4, a display control device 20*a* is used in place of the display control device 20 in the first embodiment shown in FIG. 1, and a display unit 30*a* and/or 30*b* are used in place of the display unit 30. The second exemplary configuration is the same as first exemplary configuration except for the above difference.

The display control device 20*a* according to the second embodiment can simultaneously control the two display units 30*a* and 30*b* whose display methods are different from each other. Hereinafter, as an example, it is assumed that the display unit 30*a* includes an STN display panel of a predetermined size, and the display unit 30*b* includes a TFT display panel of a different size from the STN display panel. Note that it is not necessarily required for the two display units 30*a* and 30*b* to be provided, and one of the display units 30*a* and 30*b* may be provided according to the application.

The display control device 20*a* includes the input I/F (interface unit) 21, the frame memory 22, a control information setting unit 23*a*, the image data conversion unit 24, a display clock signal generation unit 25*a*, and two output I/Fs (interface units) 26*a* and 26*b*.

The input interface unit 21 receives display information of the first display method type including image data PDT1 for the STN display panel and a plurality of parameters from the host CPU 10. The input interface unit 21 outputs the plurality of parameters of the first display method type to the control information setting unit 23*a*, along with outputting the image data PDT1 of the first display method type to the frame memory 22. The frame memory 22 stores the image data PDT1 of the first display method type that is output from the input interface unit 21.

The control information setting unit 23*a* sets first control information used for controlling the display of an image in the display unit 30*a* based on the plurality of parameters of the first display method type that the input interface unit 21 received from the host CPU 10. Also, the control information setting unit 23*a* sets second control information used for controlling the display of an image in the display unit 30*b* in accordance with setting information that specifies the selected display method out of the plurality of display methods.

The control information setting unit 23*a* includes a control information automatic generation unit 231*a* and a control register 232*a*. The control information automatic generation unit 231*a* includes a storage unit constituted by a nonvolatile memory or the like for storing pieces of the control information that are used for controlling the display of an image conforming to the respective display methods, in correspondence with the pieces of information that specify the plurality of display methods.

The control information automatic generation unit 231*a* reads out a scaler setting value and a PLL setting value of the first display method type from the storage unit. Also, the control information automatic generation unit 231*a* reads out from the storage unit a scaler setting value, various parameters, and a PLL setting value that correspond to the setting information specifying the selected display method out of the plurality of display methods.

The control register 232*a* holds, as the first control information, the plurality of parameters of the first display method type that the input interface unit 21 received from the host CPU 10, and the scaler setting value and the PLL setting value of the first display method type that were read out by the control information automatic generation unit 231*a*. These are used for controlling the display of an image in the display unit 30*a*.

Also, the control register 232*a* holds, as the second control information, the scaler setting value, the various parameters, and the PLL setting value that were read out by the control information automatic generation unit 231*a*. These are used for controlling the display of an image in the display unit 30*b*.

The image data conversion unit 24 converts the image data PDT1 of the first display method type read out from the frame memory 22 to the image data PDT2 of the second display method type, in accordance with the second control information (scaler setting value) set by the control information setting unit 23*a*.

The display clock signal generation unit 25*a* generates a display clock signal CK1 having a frequency corresponding to the first control information (PLL setting value) set by the control information setting unit 23*a*, and generates a display clock signal CK2 having a frequency corresponding to the second control information (PLL setting value) set by the control information setting unit 23*a*.

The output interface unit 26*a* outputs image data PDT [7:4] to the display unit 30*a* based on the image data PDT1 of the first display method type read out from the frame memory 22, and outputs signals for controlling the display unit 30*a* to the display unit 30*a* in accordance with the first control information set by the control information setting unit 23*a*.

For example, the output interface unit 26*a* generates a vertical synchronization signal VS1, a horizontal synchronization signal HS1, and a data enable signal DE1 in accordance with the first control information (plurality of parameters) set by the control information setting unit 23*a*, and outputs the signals to the display unit 30*a*. Also, the output interface unit 26*a* outputs the display clock signal CK1 generated by the display clock signal generation unit 25*a* to the display unit 30*a*.

On the other hand, the output interface unit 26*b* outputs image data PDT [7:4] to the display unit 30*b* based on the image data PDT2 of the second display method type that is output from the image data conversion unit 24, and outputs signals for controlling the display unit 30*b* to the display unit 30*b* in accordance with the second control information set by the control information setting unit 23*a*.

For example, the output interface unit 26*b* generates a vertical synchronization signal VS2, a horizontal synchronization signal HS2, and a data enable signal DE2 in accordance with the second control information (various parameters) set by the control information setting unit 23*a*, and outputs the signals to the display unit 30*b*. Also, the output interface unit 26*b* outputs the display clock signal CK2 generated by the display clock signal generation unit 25*a* to the display unit 30*b*.

In this way, according to the second embodiment, it is possible to control both the display unit 30*a* that uses the first display method and the display unit 30*b* that uses the second display method.

The various embodiments are not limited to the above-described embodiments and examples, and various modifications can be made by a person having ordinary skill in the art within the technical idea of the various embodiments.

What is claimed is:

1. A display control device for controlling a display unit including a display panel, the display control device comprising:

a processor that acts as:

a first interface unit that receives display information of a first display method type relating to a first display method, the first display method type including image data;

a control information setting unit that sets control information used for controlling display of an image in the display unit in accordance with setting information that specifies a display method, wherein the control information setting unit includes at least one terminal for specifying a display method, and sets the control information in accordance with a signal that shows a connection condition of the at least one terminal;

an image data conversion unit that, when a second display method that is different from the first display method is specified by the setting information, converts the image data of the first display method type to image data of a second display method type in accordance with the control information, wherein the control information comprises scaler setting values used for converting the image data of the first display method type to image data of the second display method type; and a second interface unit that outputs the image data of the first display method type when the first display method is specified by the setting information, outputs the image data of the second display method type when the second display method is specified by the setting information, and outputs a signal for controlling the display unit in accordance with the control information.

2. The display control device according to claim 1, further including a display clock signal generation unit that generates a display clock signal having a frequency that corresponds to the control information, wherein the second interface unit outputs the display clock signal generated by the display clock signal generation unit to the display unit.

3. The display control device according to claim 2, wherein the display clock signal generation unit includes a phase locked loop (PLL) circuit that generates a clock signal based on a system clock signal that is supplied from a source external to the display clock signal generation unit.

4. The display control device according to claim 2, wherein the display clock signal generation unit includes a programmable phase locked loop (PLL) circuit that generates a clock signal having a frequency that corresponds to the control information, based on a system clock signal that is supplied from a source external to the display clock signal generation unit.

5. The display control device according to claim 1, wherein when the second display method that is different from the first display method is specified by the setting information, the image data conversion unit converts an image size of the image data of the first display method type to an image size specified by the control information.

6. The display control device according to claim 1, wherein the control information setting unit includes a storage unit for storing control information that corresponds to a plurality of display methods, and reads out the control information corresponding to the setting information that specifies the display method from the storage unit.

7. The display control device according to claim 1, wherein the first display method is a display method for causing a display unit having a Super-Twisted Nematic (STN) display panel to display an image, and the second display method is a display method for causing a display unit having a Thin Film Transistor (TFT) display panel to display an image.

8. The display control device according to claim 1, further including a third interface unit that outputs the image data of the first display method type, and outputs a signal for controlling a display unit that uses the first display method in accordance with at least one parameter included in the display information of the first display method type.

9. The display control device according to claim 1, wherein the control information includes information for specifying a driving capability of an output circuit of the first interface unit.

10. The display control device according to claim 1, wherein the control information is set without receiving control information from outside the device.

11. The display control device according to claim 1, wherein the image data is converted and signals output without modifying software that controls the display or display unit.

12. The display control device according to claim 1, wherein the first and second display methods are defined by at least a number of pixels included in one frame of image data, timing information including vertical cycle and horizontal cycle timing information, and a frequency of a display clock signal.

13. A semiconductor integrated circuit device comprising the display control device according to claim 1.

14. A display device comprising:

the display control device according to claim 1; and a display unit including a display panel.

15. A display control method for controlling a display unit including a display panel, the display control method comprising:

(a) receiving display information of a first display method type relating to a first display method, the first display method type including image data;

(b) setting control information used for controlling display of an image in the display unit in accordance with setting information that specifies a display method;

(c) specifying a display method using at least one terminal, and setting the control information in accordance with a signal that shows a connection condition of the at least one terminal;

(d) converting, when a second display method that is different from the first display method is specified by the setting information, the image data of the first display method type to image data of the second display method type in accordance with the control information set in step (b), wherein the control information comprises scaler setting values used for converting the image data of the first display method type to image data of the second display method type; and (e) outputting the image data of the first display method type when the first display method is specified by the setting information, outputting the image data of the second display method type when the second display method is specified by the setting information, and outputting a signal for controlling the display unit in accordance with the control information set in step (b).

16. A display control device comprising:

a processor that acts as:

a control information setting unit that sets control information used for controlling display of an image in first and second display units in accordance with setting information that specifies a display method, the first display unit having a first display method type different than a second display method type of the second display unit, wherein the control information setting unit includes at least one terminal for specifying a display method, and sets the control information in accordance with a signal that shows a connection condition of the at least one terminal; and an image data conversion unit that converts image data between different display method types corresponding to the display methods for the first and second display units and in accordance with the control information, and outputs signals for controlling the first or second display units in accordance with the control information with receiving a first image data of the first display unit wherein the control information comprises scaler setting values used for converting the image data of the first display method type to image data of the second display method type.

17. The display control device according to claim 16, wherein the image data conversion unit converts image data between different display method types without software modification to control the first and second display units.

18. A display device comprising:

the display control device according to claim 16; and a display unit including a display panel.

* * * * *